US007489081B2

(12) United States Patent
Haselhorst et al.

(10) Patent No.: US 7,489,081 B2
(45) Date of Patent: Feb. 10, 2009

(54) LIGHT BURNER AND METHOD FOR MANUFACTURING A LIGHT BURNER

(75) Inventors: Georg Haselhorst, Roetgen (DE); Michael Haacke, Aachen (DE); Jurgen Adriaensen, Lichtaart (BE); Francis Martin Jozef Deprez, Kuringen (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 208 days.

(21) Appl. No.: 10/599,410

(22) PCT Filed: Mar. 23, 2005

(86) PCT No.: PCT/IB2005/050996

§ 371 (c)(1),
(2), (4) Date: Sep. 28, 2006

(87) PCT Pub. No.: WO2005/096334

PCT Pub. Date: Oct. 13, 2005

(65) Prior Publication Data

US 2007/0182331 A1 Aug. 9, 2007

(30) Foreign Application Priority Data

Apr. 1, 2004 (EP) ..... 04101354

(51) Int. Cl.
*H01J 17/18* (2006.01)
*H01J 61/36* (2006.01)

(52) U.S. Cl. ..... 313/623; 313/631; 313/632; 313/633; 445/26

(58) Field of Classification Search ..... 313/631, 313/632, 623–625
See application file for complete search history.

(56) References Cited

U.S. PATENT DOCUMENTS 5,936,350 A * 8/1999 Yoshida et al. ..... 313/631
6,137,228 A 10/2000 Aizawa et al.
6,369,509 B1 * 4/2002 Ookubo et al. ..... 313/623

FOREIGN PATENT DOCUMENTS

EP 0858098 A2 8/1998
EP 1 037 256 B1 9/2000
EP 1037256 A1 9/2000

* cited by examiner

*Primary Examiner*—Nimeshkumar D Patel
*Assistant Examiner*—Thomas A Hollweg

(57) ABSTRACT

The invention describes a light burner (1) comprising a discharge chamber (2) containing a gas sealed in the discharge chamber (2) by a seal (4, 5) and a pair of electrode shafts (6, 7), each of which partially intrudes from the seal (4, 5) into the discharge chamber (2) whereby a wrapping (8, 9), at least partially contained in the seal (4, 5), is freely wound around at least one of the electrode shafts (6, 7) and constrained in its motion by a number of containment elements ($P_1$, $P_2$, $P_3$, $P_4$) positioned along the longitudinal axis of the electrode shaft (6, 7).

10 Claims, 2 Drawing Sheets

LIGHT BURNER AND METHOD FOR MANUFACTURING A LIGHT BURNER

This invention relates in general to a light burner and in particular to a high-intensity discharge metal halide burner and a method for manufacturing such a light burner.

A discharge lamp is a light source in which the light is produced by a light arc between two electrodes located in a discharge chamber—often referred to as a "burner"—containing a particular mixture of gases. For some applications, such a light source can comprise additionally an outer bulb. For example in a metal halide lamp, such as a so-called high-intensity discharge (HID) lamp, the gas mixture is usually a combination of a noble starting gas such as xenon or argon together with one or more metal halides such as sodium iodide, scandium iodide or similar and, optionally, mercury. The light arc comprises radiation from the metal halides and mercury, if used. In the following, the term "burner" is used to refer to any kind of such an "inner" light bulb regardless of whether an outer bulb is used or not.

The burner can be manufactured by heating quartz glass to a sufficiently high temperature until it becomes malleable, enabling formation of a gas capsule as the discharge chamber. Part of the manufacturing process comprises introducing the appropriate filling into the discharge chamber, and sealing the chamber by closing off the malleable glass of the bulb at one or more positions in a process known as pinching. The resulting elongated and sometimes flattened area of quartz glass at one or more positions on the discharge chamber is commonly referred to as the pinch or seal. The electrodes can be incorporated into the burner at the same time by pinching them into the seal or seals, or they may be pressed into the molten quartz glass. One inner end of each electrode intrudes into the discharge chamber while the outer end, usually enclosed in a quartz glass pinch, is connected in some manner to an external conductor.

In order to generate light, an igniter applies a very high voltage between the tips of the electrode to establish an arc of ionised gas between the electrodes which heats the enclosed filling to vaporisation point of the non gaseous parts of the filling. The noble gas delivers some light output during run-up before the other ingredients have vaporized. Stable operation is generally reached within a short space of time when total vaporisation has occurred and the metal halide burner produces its full light output.

The current which initially flows through the electrodes during the ignition process is relatively high, so that temperature of the electrodes rapidly attains a high value. An arc can thus be established across the electrodes. The high temperatures attained result in thermal expansion of the components of the burner. Since the coefficient of thermal expansion of quartz is very low in comparison to that of the electrode metal, the expansion of the electrodes places the surrounding quartz glass under stress and could ultimately lead to cracking of the quartz glass seal.

A number of attempts have been made to address the problem of cracking. For example, instead of having the outer end of the electrode emerge from the quartz glass pinch, it also is contained within the quartz glass seal, and is connected to an external conductor by means of a molybdenum foil. Molybdenum foil of very thin cross-section barely expands when heated, so that the quartz in direct contact with this foil is essentially unaffected by the high temperatures attained. The molybdenum foil is sealed in the quartz glass pinch during the pinching process. One edge of the foil is connected to an external conductor, and the opposite edge is connected to the electrode inside the pinch. The edges of the foil are made very thin, either by rolling or etching, and these knife edges can deform and bury themselves in the quartz as they expand without cracking it. In this way, the quartz glass remains intact at least at the outer extremity of the pinch.

However, cracking can still occur in the area of the pinch around the electrode, which expands in all directions during operation. At the very least, cracks and fissures allow metal salts and any mercury to diffuse from the discharge chamber along the electrodes. Creep of components of the gas filling from the discharge vessel up to the molybdenum contact foil results in the molybdenum foil peeling off, thus shortening the useful life-time of the burner. Also, the decrease in the amounts of mercury and metal salts remaining in the discharge chamber results in a considerable reduction in luminous flux of the lamp. This is a particularly undesirable effect, when, for example, the burner is found in an automobile headlight, where constant brightness and reliable function are of paramount importance. In an effort to reduce this problem, some attempts have been made to eliminate direct contact between the quartz glass and the electrode by wrapping a metal coil at least partly around the electrode shaft. The shaft of an electrode can hereby be defined as an essentially cylindrical section of the electrode, of sufficient length to contain a coil, regardless of the way the shaft has been formed and whether it is the thicker or thinner part of the electrode. For example, EP 1 037 256 A1 shows a wire coiled around an electrode shaft, where the coil is directly fixed by, for example, resistance-welding to the electrode shaft. The coil is contained in the quartz glass pinch and is intended to act as a type of thermal bridge between the very hot electrode and the relatively cooler quartz glass. Nevertheless, since the coefficients of thermal expansion for the quartz glass and the electrode/wrapping differ greatly, this construction can still lead to additional stress in the pinch, resulting in eventual cracking of the quartz glass and reducing the life-time of the burner.

Therefore, an object of the present invention is to provide a burner in which the occurrence of stress in the pinch due to thermal expansion during operation is reduced, thereby prolonging the life-span of the burner.

To this end, the present invention provides a burner comprising a discharge chamber containing a gas sealed in the discharge chamber by a seal, a pair of electrodes, each of which partially intrudes from the seal into the discharge chamber, whereby a wrapping, at least partially contained in the seal, is freely wound around at least one of the electrode shafts and constrained in its motion by a number of containment elements positioned along the longitudinal axis of the electrode. Preferably, a wrapping is positioned about each of the electrodes. Therefore, the electrode construction which is contained in the pinch comprises not only the usual electrode shaft, but also a wrapping of some kind, which is not fixed to the electrode shaft.

In the present invention, the problem of cracks appearing in the quartz glass during operation of the burner is therefore addressed by introducing a wrapping, free to move about the electrode shaft, prior to introducing the electrode into the burner during the manufacturing process. Even during the pinch processing, substantial free movement of the wrapping over the electrode shaft is allowed in both radial and axial directions. This is achieved by containment of the wrapping on the electrode shaft within extra positioning elements. Such a wrapping or "overwind" is preferably made of metal in a form of a coil, therefore is also referred to as coil in the following. Nevertheless, other realisations of the wrapping may be possible, for example in a form of a foil.

An appropriate method for manufacturing such a burner comprising a discharge chamber closed by a seal, and a pair of electrodes, each of which partially intrudes from the seal into the discharge chamber, involves the inclusion of wrapping, at least partially contained in the seal, around at least one of the electrodes, and positioning a number of containment elements along the longitudinal axis of the electrode shaft so as to constrain the wrapping in its motion without directly fixing the wrapping to the electrode shaft. Due to possible resilience and degrees of freedom in the longitudinal and radial directions, the mechanical stress in the quartz pinch can be reduced by the wrapping to a greater degree than by a wrapping which is fixed to the electrode shaft, for example by welding.

Owing to the high temperatures required to soften the quartz glass during the manufacturing process, the electrode and wrapping are also heated, and expand as a result. After pinching the seals, the burner is allowed to cool. Since the metal of the electrode and wrapping also retract more upon cooling than the quartz, a "flexible interface" appears between the metal and the quartz glass. During subsequent operation of the burner with associated heating of the electrode shaft and coil, the wrapping is able to minimize interface stress in longitudinal and radial direction. The lateral movement of the wrapping is, in its extreme, constrained by containment elements placed at certain positions along the length of the electrode. During manufacturing, known pinching and sealing processes for HID gas discharge lamps can be applied.

An advantage of this construction is that the coil is not welded to the electrode shaft at any point along its length, thus eliminating such cracking due to mechanical stress caused by thermal expansion as might occur at such a weld. A further advantage is that the coil is free to expand in all directions, allowing more degrees of freedom in design and manufacture of the coil, such as a reduction in coil wire diameter, and the possibility of choosing a more advantageous pitch and coil length. The aspect ratio of the coil inner diameter to the coil wire diameter can be chosen with higher ratios than can be attained in the current state of the art.

The dependent claims and the subsequent description disclose particularly advantageous embodiments and features of the invention.

Generally, metal halide burners are made of quartz glass in the manner already described. However, the burner can be made of a different, equally suitable, material, such as ceramic. In the following, where, for the sake of simplicity, reference is made to quartz glass, it is taken to be understood that the invention can equally be applied to other suitable materials.

In a particularly preferred embodiment of the invention, the electrodes might intrude into the discharge chamber from a pair of quartz glass seals situated on opposing sides of the discharge chamber, so that the electrodes essentially lie along a shared longitudinal axis. Alternatively, the electrodes might both intrude into the discharge chamber from a single quartz glass seal. The ends of the electrodes in the discharge chamber are separated by a gap, while the ends of the electrodes in the quartz glass seal might be directly or indirectly attached to conductors or lead-in wires from an external power supply.

The containment elements might be formed in a number of ways prior to manufacture of the burner. The containment elements might be formed from the body of the electrode shaft, or might be introduced into the molten quartz glass at the desired position during the manufacturing process.

In a preferred technique, a laser beam with a dedicated pulse shape, energy and sequence is directed at the electrode shaft, preferably essentially at right angles, so that the material of the electrode shaft is softened or melted at the point of contact of the laser beam with the electrode shaft. The melted material might be shaped by the gas flow arising from the heat generated by this operation into the desired shape for the containment element to give a type of pin. Here, a "pin" can mean any protuberance from the body of the electrode shaft, such as a cam. These pins can be formed at any desired location on the surface of the electrode shaft.

The height of a containment element is preferably chosen so that it can effectively prevent the wrapping from moving past it on the electrode shaft during operation of the burner or during the manufacturing process. The containment elements might also be shaped by an alternative method, for example by employing a suitable mechanical method.

The placement of the containment elements on the electrode shaft is such that the movement of the wrapping along the electrode shaft is constrained only in a lateral direction along the length of the electrode. A single containment pin, positioned at some point along the length of the electrode and offset from an outer edge of the wrapping, might suffice to fix the coil at this position on the electrode while leaving the coil free to expand laterally outwards from this position along the electrode.

In a preferred embodiment of the invention, two pins are positioned on the electrode shaft with the wrapping positioned between them. Most preferably, these pins are positioned such that a gap exists between each pin and the wrapping. The wrapping is thus free to expand during operation of the burner up to the length given by the distance between the two containment pins. Since the amount of expansion of the wrapping is a function of its physical dimensions, its material properties, and the temperatures attained during operation, the distance between the pins is preferably chosen to accommodate the expansion allowed by these factors. One advantage of this construction is in its simplicity. After forming a first pin, the wrapping can be slipped over the electrode shaft and held against the first pin whilst the second pin is being formed. Once the formation of the second pin is complete, the wrapping, for example a coil with a pitch larger than its wire diameter, having some elasticity along its longitudinal axis, is released.

A further possible construction would be to employ more than one pin at the ends of the wrapping to restrain its movement. For example, two or more pins could be positioned about an end of the wrapping to ensure that it will not wander too far even if it should rotate about the electrode shaft during operation. The pins might be individually formed at separate locations, or might merge into each other. A series of pins might be formed to circumscribe the electrode, and might join together to form a type of flange.

The wrapping is preferably made of metal with a high melting point, most preferably of tungsten, molybdenum, or an alloy.

The coil may be first formed to the desired dimensions before being subsequently slipped over the shaft of the electrode. Using known techniques such as "pot-flyer", "break head" etc., for example tungsten coils are first formed on a molybdenum carrier. After coiling, heat treatment is applied to release stress from the coil wire, which is then cut to its final length, for example by wire sawing. This wire cutting technique achieves a superior cutting quality ensuring that the inner coil diameter is maintained at the coil ends. After wire sawing, the inner molybdenum carrier can be etched using standard known methods.

Equally, the coil can be shaped by directly winding a wire around the shaft of the electrode, for example by using the "coiling-on-needle" technique or "coiling-on-rod".

The coil and appropriate containment elements can be placed at any position along the electrode, for example the wrapping might intrude to some extent into the discharge chamber along with the electrode or the end of the wrapping within the quartz glass pinch might extend over the molybdenum foil, whilst the other end remains free to move laterally along the electrode. However, in a particularly advantageous arrangement, the coil is positioned so that it is entirely contained within the quartz glass seal without being fastened to the molybdenum foil, and is free to move laterally along the electrode in the region of the pinch. An important advantage of this construction is that gaps in the pinch are prevented from occurring in the area close to the discharge chamber, thus hindering the migration of metal halides or any mercury along the electrode. Another advantage is that, since it is free to move laterally, the coil is free of any tension which might otherwise lead to stress-induced cracking of the glass in the pinch.

The preferred physical dimensions of the wrapping such as wire thickness or diameter, number of turns of the coil, pitch, inner and outer wrapping diameters etc. can be determined to a large extent by the material properties and coefficient of thermal expansion of the metal used. It is recommended to choose the pitch and wire diameter so that the wire can expand freely in a radial direction. The pitch of a coil is defined as the distance between the centres of two adjacent turns of the coil, divided by the diameter of the wire, and multiplied by 100. A pitch of 100 for a coil implies that the coil is wound so that the adjacent turns of the coil are in contact with one another. For a coil where the distance between the adjacent turns is five times the diameter of the wire, the pitch is calculated to be 500. Other factors in choosing the dimensions of the wrapping might be dictated by the material properties of the glass such as viscosity. For example, the pitch of the wrapping is preferably chosen so that the molten viscous quartz glass may not enter the space between the inner diameter of the wrapping and the electrode shaft during pinching of the quartz glass seal. Preferably, the pitch of the wrapping allows an optimal degree of fill of the quartz glass between the turns of the coil.

During the manufacturing process, the quartz glass is heated, resulting also in an indirect heating and associated expansion of the electrode and wrapping. After sealing the discharge chamber and pinching the electrode and wrapping in the seal, the quartz glass is allowed to cool down again. However, the metal of the electrode and the wrapping also retract upon cooling, so that a flexible interface, in the extreme a small gap, appears between the quartz glass of the pinch and the wrapping. This flexible interface allows the wrapping to expand radially outwards during operation of the burner.

The spacing between the inner diameter of the wrapping and electrode shaft is preferably chosen so that the movement of the wrapping along the electrode shaft is not inhibited. In an advantageous embodiment of the invention, the inner diameter $D_{inner}$ of the wrapping is, chosen to be slightly bigger then the diameter $D_e$ of the electrode shaft, so that there is a slight gap between electrode shaft and wrapping. The lower limit for the size of the gap is determined by friction arising during mounting of the wrapping over the electrode. Too much friction would result in the wrapping being damaged. The upper limit for the gap size is determined by the height of the containment pins, which in turn depends on the thickness of the electrode shaft. The ends of the wrapping might be bent inwards a little to ensure that the wrapping is not offset from the electrode shaft and that the slight gap is maintained all around the electrode shaft, so that the material of the wrapping can expand radially inward without being unduly pressed against the surface of the electrode shaft.

Preferred ranges of values for the dimensions are listed in the following:

The diameter of the electrode shaft $D_e$ is preferably between 100 μm and 1180 μm, and more preferably between 250 μm and 500 μm.

The coil wire diameter $D_w$ is preferably between 15 μm and 500 μm, and more preferably between 25 μm and 120 μm.

The coil inner diameter $D_{inner}$ is preferably between 112 μm and 1250 μm, and more preferably between 268 μm and 378 μm.

The pitch of the coil is preferably between 100 and 500, more preferably between 110 and 175.

The gap between electrode shaft and wrapping is preferably between 5 μm and 200 μm, more preferably between 15 μm and 50 μm.

The height of the containment pins is preferably greater than the difference between electrode shaft diameter and wrapping inner diameter, and less than one and a half times the wrapping thickness plus the difference between electrode shaft diameter and wrapping inner diameter, and is more preferably equal to half the wrapping thickness plus the difference between electrode shaft diameter and wrapping inner diameter.

Other objects and features of the present invention will become apparent from the following detailed descriptions considered in conjunction with the accompanying drawings. It is to be understood, however, that the drawings are designed solely for the purposes of illustration and not as a definition of the limits of the invention.

In the drawings, wherein like reference characters denote the same elements throughout:

The dimensions of the objects in the figures have been chosen for the sake of clarity and do not necessarily reflect the actual relative dimensions.

Figure 1:
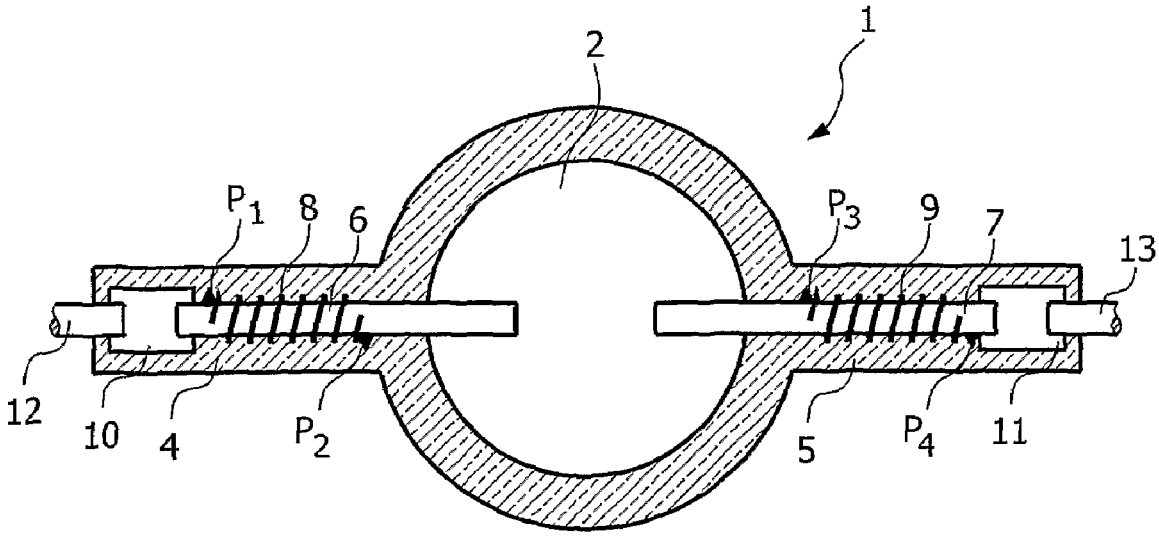
FIG. 1 shows a burner in accordance with an embodiment of the present invention.

FIG. 1 shows a high-intensity discharge metal halide burner 1 of a type used, for example, in automobile headlights. The burner 1 is made of quartz glass, and is manufactured as describe above by heating the glass to a molten stage when it is then moulded to the desired shape. A discharge chamber 2 is moulded and filled with a certain mixture of gases. In this example, the filling comprises mercury, which gives off an intense white light radiation when heated beyond a certain temperature, a pressurized starter gas such as xenon or argon, and metal halides or salts such as sodium iodide, scandium iodide etc. The choice of metal halide influences the colour of the light, whereas the noble gas, when ionised by a voltage difference across the electrode shafts 6, 7 during ignition, allows a light arc to be established between the electrode shafts 6, 7, and heats the metal halides to vaporisation point.

The electrode shafts 6, 7 are positioned to lie along a shared longitudinal axis, with inner ends facing each other across within the discharge chamber 2, and the outer ends enclosed in the quartz glass pinches 4, 5. Such electrode shafts 6, 7 preferably have a diameter in the range of 250 μm to 500 μm.

The outer end of each electrode shaft 6, 7 is connected to a piece of molybdenum foil 10, 11, which in turn is connected to a conductor 12, 13. A ballast including an igniter, not shown in the figure, applies a voltage to the electrode shafts 6, 7, via the conductors 12, 13.

A wrapping 8, 9, here a coil of metal wire, is placed around each electrode shaft 6, 7. Most preferably the values for coil thickness are 25 μm to 120 μm, while the inner diameter of the coil is preferably between 268 μm and 378 μm. The lateral movement of each wrapping 8, 9 is constrained by containment pins $P_1$, $P_2$, $P_3$, $P_4$ placed at strategic positions on the electrode shafts 6, 7. Two containment pins $P_1$, $P_2$ and $P_3$, $P_4$ have been formed from the body of each electrode shaft 6, 7 such that they are positioned beyond either end of each overwind 8, 9 to contain the lateral movement of the wrappings 8, 9.

Figure 2:
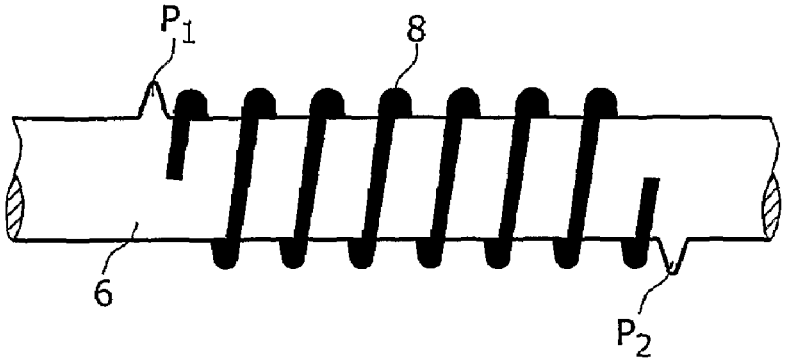
FIG. 2 shows an electrode shaft, wrapping and an example for containment elements according to an embodiment of the present invention.

FIG. 2 shows how the coil 8 is positioned between the containment pins $P_1$, $P_2$ on the electrode shaft 6. The pins $P_1$, $P_2$ have been formed from the body of the electrode shaft 6 at such a distance from each other that the coil 8 is comfortably placed between them, with gaps at either end to allow for lateral expansion caused by heating during operation of the burner 1. The pins $P_1$, $P_2$ have been formed by directing a laser beam with dedicated pulse shape and energy at right angles to the body of the electrode shaft 6 to soften the material of the electrode shaft, which was then moulded into the desired shape.

Figure 3:
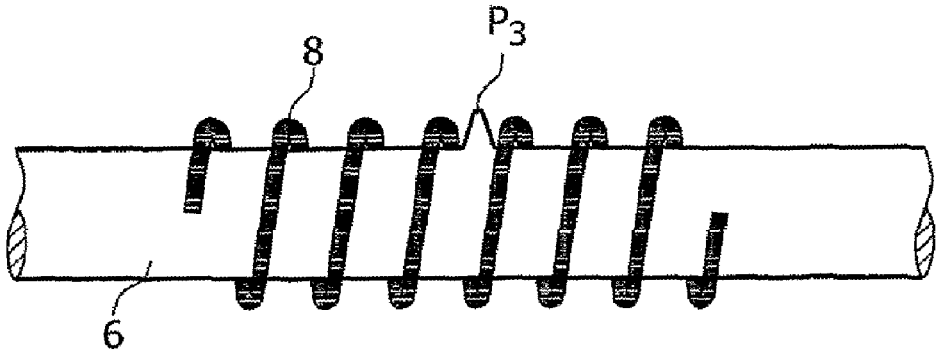
FIG. 3 shows an electrode shaft, wrapping and containment elements according to an embodiment of the present invention.

FIG. 3 shows an alternative construction where a single pin $P_3$ has been formed out of the body of the electrode shaft 6. The coil 8 is positioned on the electrode shaft 6 in such a way that it is essentially centred around the pin P3 and is free to expand laterally to the left and right of the pin. However, unwanted lateral movement of the wrapping 8 is prohibited by the pin $P_3$, so that the coil 8 cannot wander along the length of the electrode shaft 6.

Figure 4:
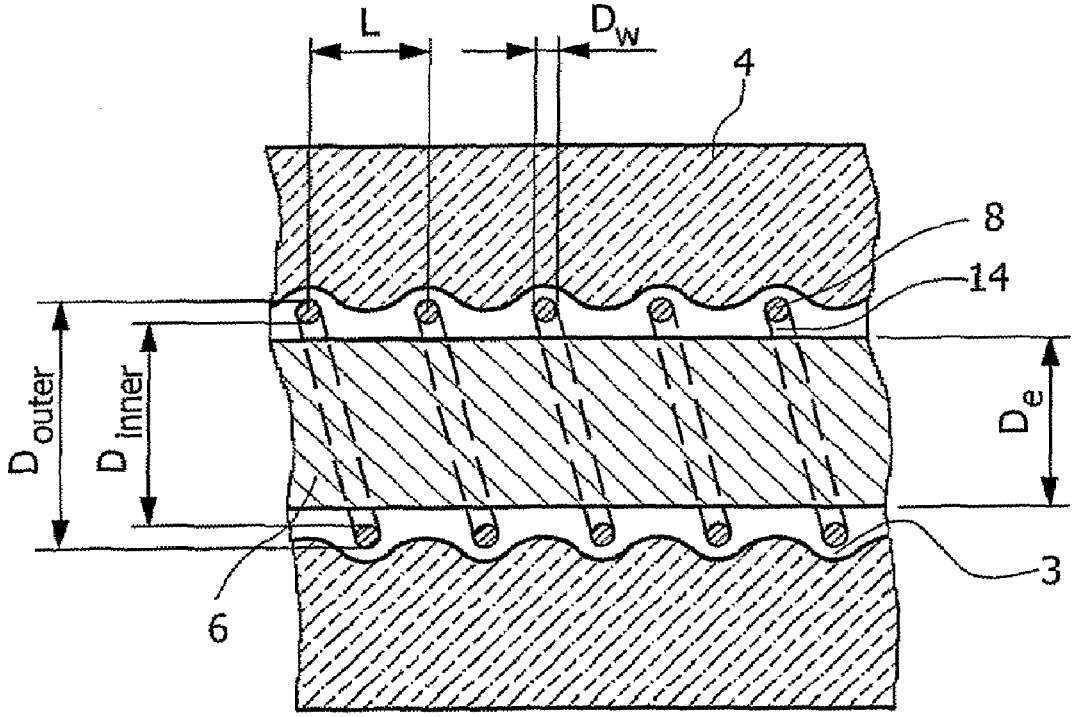
FIG. 4 shows a longitudinal cross-section of an area within a quartz glass pinch of a burner according to an embodiment of the present invention.

FIG. 4 shows a longitudinal cross-section through an area of the pinch 4 after cooling. The metal of the coil 8 has retracted to leave a flexible interface 3 between the coils of the coil 8 and the quartz glass of the pinch 4. The inner diameter $D_{inner}$ of the coil 8 has been chosen to be slightly greater than the diameter $D_e$ of the electrode shaft, so that a space 14 is left between coil 8 and electrode shaft 6. The size of this gap might preferably be between 15 μm and 50 μm. In this example, the pitch is small enough to prevent the molten quartz glass from entering the space 14 between the coil 8 and the electrode shaft 6, while being large enough to allow the turns of the coil 8 to expand radially during operation of the lamp 1. Typical values of preferred coil pitch lie between 100 and 175.

During operation of the burner 1, when the electrode shaft 6 heats up, the heat is partially transferred to the coil 8, which then freely expands in lateral and radial directions. The electrode shaft 6 can also expand radially in the area of the coil 8 without pressing against the quartz glass of the pinch 4. The individual turns of the wrapping 8 can expand radially inwards towards the electrode shaft 6 within the gap 14, radially outwards towards the quartz glass of the pinch 4 within the gap 3 and laterally towards each other.

Although the present invention has been disclosed in the form of preferred embodiments and variations thereon, it will be understood that numerous additional modifications and variations could be made thereto without departing from the scope of the invention. The technique of stress reduction according to the invention can be applied to all types of light burners. Furthermore, any kind of wrapping, for example a coil or metal foil, can be positioned between the containment pins on the electrode shaft.

For the sake of clarity, it is also to be understood that the use of "a" or "an" throughout this application does not exclude a plurality, and "comprising" does not exclude other steps or elements.

The invention claimed is:

1. A light burner comprising:

a discharge chamber containing a gas sealed in the discharge chamber by a seal;

a pair of electrode shafts, each of which partially intrudes from the seal into the discharge chamber;

a wrapping, at least partially contained in the seal, freely wound around at least one of the electrode shafts; and a number of containment elements positioned along the longitudinal axis of the electrode, wherein the number of containment elements are configured to (i) constrain the wrapping in its motion and (ii) allow substantial free movement of the wrapping to expand over the electrode shaft in both radial and axial directions within the constrained motion.

2. The burner of claim 1, wherein the containment elements comprise containment pins affixed at certain positions along the lengths of the electrode shafts.

3. The burner according to claim 2, wherein the containment pins are moulded from the body of the electrode shaft.

4. The burner according to claim 1, wherein the wrappings are entirely contained by the quartz glass seals.

5. The burner according to claim 1, wherein a slight gap exists between the wrapping and the electrode shaft.

6. A method for manufacturing a burner comprising a discharge chamber closed by a seal, a pair of electrode shafts, each of which partially intrudes from the seal into the discharge chamber, a wrapping, at least partially contained in the seal, freely wound around at least one of the electrode shafts, and a number of containment elements positioned along the longitudinal axis of the electrode shaft and configured to constrain the wrapping in its motion while allowing substantial free movement of the winding to expand over the electrode shaft in both radial and axial directions within the constrained motion.

7. The method according to claim 6, wherein the wrapping is wound directly around the electrode shaft.

8. The method according to claim 6, wherein the wrapping is first wound before being placed over the electrode shaft.

9. The method according to claim 6, wherein containment elements are formed from the body of the electrode shafts.

10. The method according to claim 9, wherein a laser beam is directed at the electrode shaft, so that the material of the electrode shaft is softened or melted at the point of contact of the laser beam with the electrode shaft to form the containment elements.

* * * * *